United States Patent [19]

Say

[11] Patent Number: 4,766,344

[45] Date of Patent: Aug. 23, 1988

[54] IN-LINE ELECTRON GUN STRUCTURE FOR COLOR CATHODE RAY TUBE HAVING OBLONG APERTURES

[75] Inventor: Donald L. Say, Waterloo, N.Y.

[73] Assignee: North American Philips Consumer Electronics Corp., New York, N.Y.

[21] Appl. No.: 487,347

[22] Filed: Apr. 21, 1983

[51] Int. Cl.[4] ..... H01J 29/62

[52] U.S. Cl. ..... 313/414; 313/458

[58] Field of Search ..... 313/414, 453, 458, 449, 313/460

[56] References Cited

U.S. PATENT DOCUMENTS 4,318,026 3/1982 D'Amato ..... 313/414 X 4,370,592 1/1983 Hughes et al. ..... 313/414

FOREIGN PATENT DOCUMENTS 57-151153 9/1982 Japan ..... 313/414

58-40755 3/1983 Japan ..... 313/414

*Primary Examiner*—David K. Moore

*Assistant Examiner*—K. Wieder

*Attorney, Agent, or Firm*—John C. Fox

[57] ABSTRACT

The effective aperture sizes of the final focusing and accelerating electrodes of an in-line electron gun structure for color cathode ray tubes are increased by elongating the apertures, expanding the outer edges of the side apertures, and surrounding the apertures with a peripheral raised rim which balances the asymmetry introduced into the apertures by enlargement. Partitions between the aperture may be radiused so their center height is lower than the height at the edges. The raised rim of the final accelerating electrode is generally higher than the raised rim of the focusing electrode.

9 Claims, 2 Drawing Sheets

IN-LINE ELECTRON GUN STRUCTURE FOR COLOR CATHODE RAY TUBE HAVING OBLONG APERTURES

BACKGROUND OF THE INVENTION

This invention relates to an in-line electron gun structure for color cathode ray tubes (CCRT), and more particularly relates to an improved lensing arrangement whereby the effective apertures of the final and focusing accelerating electrode lenses are increased.

Reducing the diameter of the necks of CCRTs can lead to cost savings for the television set maker and user in enabling smaller beam deflection yokes and consequent smaller power requirements. However, reducing neck diameter while maintaining or even increasing beam deflection angle and display screen area severely taxes the performance limits of the electron gun.

In the conventional, in-line electron gun design, an electron optical system is formed by applying critically determined voltages to each of a series of spatially positioned apertured electrodes. Each electrode has at least one planar apertured surface oriented normal to the tube's long or Z axis, and containing three side-by-side or "in-line" circular straight-through apertures. The apertures of adjacent electrodes are aligned to allow passage of the three(red, blue and green) electron beams through the gun.

As the gun is made smaller to accommodate the so-called "mini-neck" tube, the apertures are also made smaller and the focusing or lensing aberrations of the apertures are increased, thus degrading the quality of the resultant picture on the display screen.

Various design approaches have been taken to attempt to increase the effective apertures of the gun electrodes. For example, U.S. Pat. No. 4,275,332, and U.S. patent application Ser. No. 303,751, filed Sept. 21, 1981 and assigned to the present assignee, describe overlapping lens structures. U.S. Ser. No. 463,791, filed Feb. 4, 1983 and assigned to the present assignee, describes a "conical field focus" lens arrangement. Each of these designs is intended to increase effective apertures in the main lensing electrodes and thus to maintain or even improve gun performance in the new "mini-neck" tubes.

It is an object of the present invention to provide an alternate electron gun structure which has increased effective apertures in the main lensing electrodes, but which does not rely on overlapping lenses or a "conical field focus" arrangement.

SUMMARY OF THE INVENTION

In accordance with the invention, a lensing arrangement is provided in the final focusing and accelerating electrodes of an in-line electron gun for a CCRT, which arrangement provides increased effective apertures in these electrodes over the circular apertures of the prior art.

Such arrangement involves the final low voltage (focusing) and high voltage (accelerating) electrodes. The forward portion of the focusing electrode and the rear portion of the accelerating electrode are in adjacent, facing relationship, and each defines three vertically elongated in-line apertures, a central aperture and two side apertures.

In a preferred embodiment, the central aperture is oblong-shaped, and the two side apertures are "D"-shaped.

As used herein, the term "oblong" means deviating from a "rounded square" or circular form through elongation, such elongation being parallel to a side in the case of a rounded square and along a radius in the case of a circle. A "rounded square" form means the shape resulting from rounding the corners of a square.

As used herein, the term "D-shaped" means the form resulting from rounding the corners of a "D". The apertures are contained in an elongated cavity defined by an upstanding perimetrical rim, and the central apertures are separated from the side apertures by upstanding partition walls extending across the cavity. The height of at least a central portion of the walls is substantially less than the height of the rim. The height of the rim of the accelerating electrode is preferably greater than the height of the rim of the focusing electrode.

In one embodiment, the height of the partition walls is constant across the width of the cavity.

In another embodiment, the height of the partition walls decreases toward the center of the cavity.

DESCRIPTION OF THE PREFERRED EMBODIMENT

For a fuller understanding of the present invention, together with other and further objects, advantages and capabilities thereof, reference is made to the following disclosure and appended claims in conjunction with the accompanying drawings.

Figure 1:
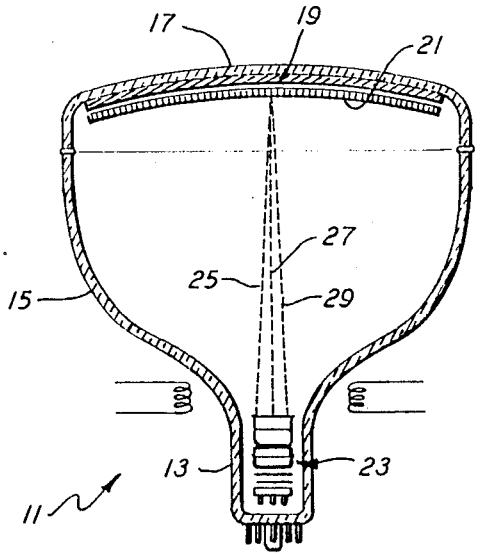
FIG. 1 is a sectioned elevation view of a color cathode ray tube wherein the invention is employed.

With reference to FIG. 1 of the drawings, there is shown a color cathode ray tube (CCRT) 11 of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel in spatial relationship to the patterned screen.

Encompassed within the envelope neck portion 13 is a unitized, plural beam in-line electron gun assembly 23, comprised of an integration of three side-by-side gun structures. Emanating therefrom are three separate electron beams 25, 27, and 29 which are directed to pass through mask 21 and land upon screen 19. It is within this electron gun assembly 23 that the structure of the invention resides.

Specifically, the invention relates to modification of the apertures in the low and high potential lensing electrodes of the gun assembly 23. For purposes of illustration, the invention will be described herein in relation to a Uni-Bi gun structure 23, partially shown in FIG. 2, wherein the low potential lensing electrode will be the main focusing electrode 31, and the adjacent high potential lensing electrode will be the final accelerating electrode 33. Terminally positioned on the final accelerating electrode is a state-of-the-art plural-apertured convergence cup 35. The several unitized electrodes comprising the gun assembly 23 are conventionally fixed in spaced relationship by a plurality of insulative support rods, not shown.

The structural aspects of the invention relate to modifications of the apertures in both the main focusing electrode 31 and the spatially associated final accelerating electrode 33, since they work conjunctively to form the final lensing arrangement of the distributed lensing system of the electron gun structure. The two electrodes, as illustrated in FIG. 2, each have adjacent, facing apertured portions, which cooperate to focus and accelerate each of the three electron beams toward a convergent point on the screen.

Figure 2:
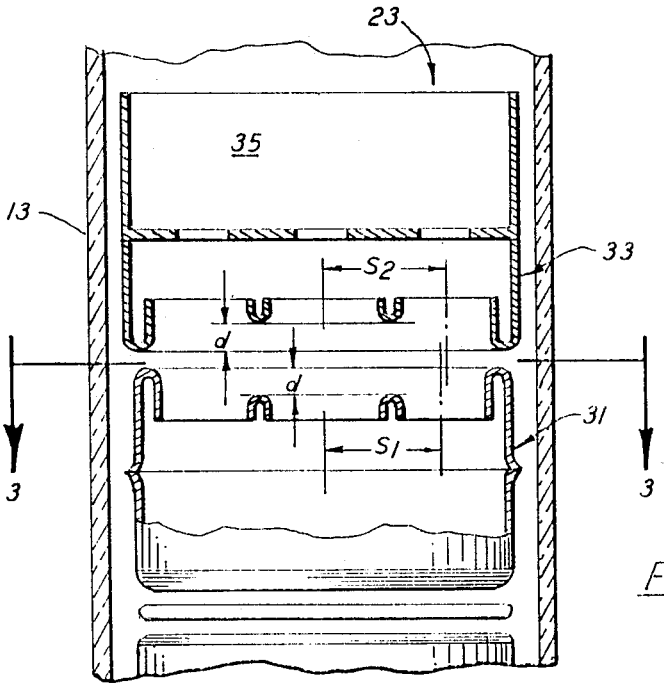
FIG. 2 is a sectioned view of the forward portion of the in-line plural beam electron gun assembly shown in FIG. 1, such view being taken along the in-line plane thereof in a manner to illustrate one embodiment of the invention.
Figure 3:
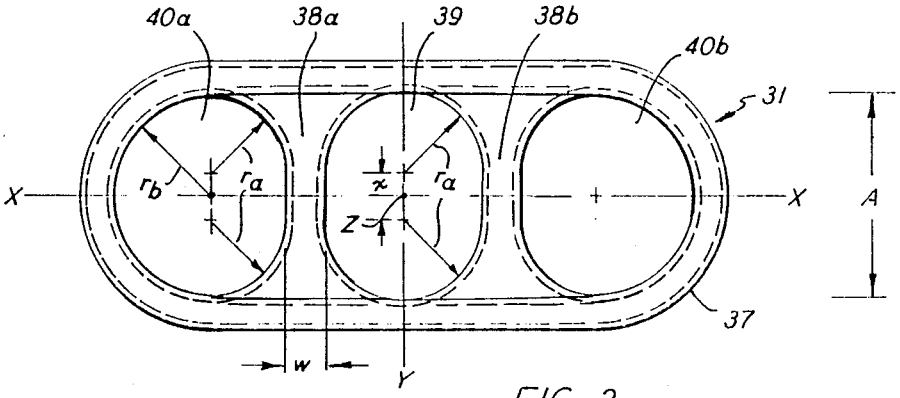
FIG. 3 is a plan view of the unitized low potential lensing electrode of the gun assembly taken along the plane of 3—3 in FIG. 2.

Referring now to FIG. 3, there is shown a plan view of the low potential electrode 31 taken along the plane 3—3 in FIG. 2. Oblong aperture 39 is separated from D-shaped apertures **40*a* and 40*b* by partition walls 38*a* and 38*b*. In this embodiment, aperture 39 is in the shape of an elongated circle of radius $r_a$, elongated by the distance x along the radius normal to both the tube's Z axis and the tube's X axis which lies in the gun's in-line plane. Aperture 40*a* can be described as having a right side and a left side, separated by an axis parallel to the elongation radius of aperture 39. The right side is in the same shape as the right half of aperture 39, being generated by the elongation of a semi-circle of radius $r_a$ by a distance x. The left side of aperture 40*a* is a semi-circle of radius $r_b$, equal to $r_a$ plus $\frac{1}{2}$ x. Aperture 40*b* is in the shape of a mirror image of aperture 40*a*. The center of each aperture lies on the tube's X axis, while the center of the aperture 39 also lies at the intersection of the tube's X, Y and Z axes. The "centers" of apertures 40*a* and 40*b*** are closer to the inside edge of the apertures than to the outside edge at the X axis by the distance $\frac{1}{2}$ x. The aperture centers lie in the centers of the electron beam paths.

Aperture size has thus been increased by vertical elongation of the apertures, and by horizontal enlargement of the side apertures to an outside radius defined peripherally by rim 37. Because rim 37 peripherally surrounds all three apertures and rises above partition walls **38*a* and 38*b***, it creates an astigmatic field which defines a large effective lens diameter and partially offsets the astigmatism caused by the assymetry of the side apertures. The assymetry caused by the lack of a "raised" rim on the left and right edges of the center aperture and on the inside edges of the side apertures is balanced by the assymetry caused by the aperture edges being closer to the beam paths along the X axis.

The final lensing of each of the electron beams is accomplished as shown in FIG. 2, by the larger-than-usual lenses formed interspatially between the main focusing electrode 31 and the final accelerating electrode 33, the influencing fields of which extend into the opposed cavities of the respective facially-oriented apertures.

These apertures effect optimum utilization of the respective electrode areas available. For example, in a typical main focusing electrode of a 29 mm electron gun the open aperture size can be increased from a normal diameter of substantially 0.216 inch to a beneficially larger diameter of substantially 0.250 inch. Dimensional changes of this sort are quite significant in CCRT electron gun assemblies.

It has been found that utilization of similar shaped apertures in the final accelerating electrode that are of slightly larger dimension than the similarly shaped apertures in the main focusing electrode results in the formation of lenses exhibiting significantly superior lensing characteristics. Such lensing provides a marked improvement (typically approximately a 20 percent reduction) in the size of the beam spot landings in comparison with those realized by conventional electrode apertures.

It has been found advantageous to have the height (d) of the rim of the accelerating electrode about 10 to 30 percent greater than the height (d) of the rim of the focusing electrode, thereby canceling a tendency of the focusing electrode to astigmatically focus the beams.

It has also been found advantageous, as is known for prior lens designs, to have the side apertures of the accelerating electrode spaced further from the center aperture than in the focusing electrode to produce an intended offset from the side apertures of the focusing electrode, thus causing beam convergence at the screen of the tube.

An exemplary usage of the above-described embodiment of the invention is presented in a gun assembly for a 29 mm neck. The main focusing electrode potential is substantially within the range of 25 to 35 percent of the final accelerating electrode potential. The inter-electrode spacing between the low potential main focusing electrode 31 and the high potential final accelerating electrode 33 is substantially 0.045". Electrode dimensions are substantially as follows:

| | Dimensions in the order of: |
|---|---|
| Main Focusing Electrode (31) | |
| Beam Spacings ($S_1$) center-to-center | 0.260 inch |
| Dia. (A) of Apertures (39, 40a, 40b) | 0.250 inch |
| Height (d) of Rim (37) above Walls (38a, 38b) | 0.040 inch |
| Radius ($r_a$) | 0.108 inch |
| Radius ($r_b$) | 0.125 inch |
| Elongation (x) | 0.034 inch |
| Width (w) of Walls (38a, 38b) | 0.044 inch |
| Final Accelerating Electrode (33) | |
| Beam Spacings ($S_2$) center-to-center | 0.267 inch |
| Dia. (A) of Apertures | 0.264 inch |
| Height (d) of Rim (37) above Walls | 0.050 inch |
| Radius ($r_a$) | 0.115 inch |
| Radius ($r_b$) | 0.132 inch |
| Elongation (x) | 0.034 inch |
| Width (w) of Walls | 0.030 inch |

It is to be understood that the foregoing exemplary dimensions are not to be considered limiting to the concept of the invention.

Figure 5:
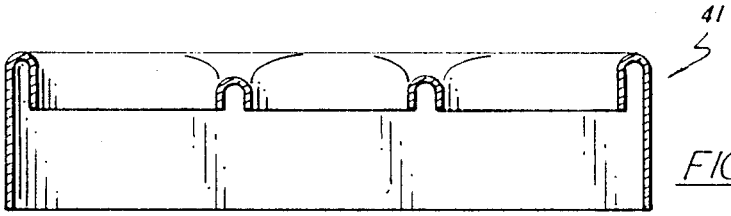
FIG. 5 is a sectioned elevational view of the embodiment of the low potential electrode of FIG. 4 taken along the in-line plane 5—5 in FIG. 4.
Figure 4:
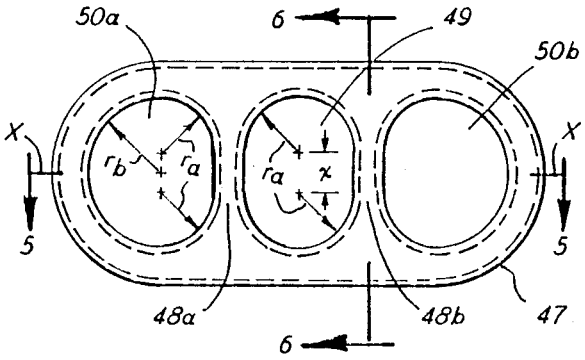
FIG. 4 is a plan view of another embodiment of the unitized low potential lensing electrode of the invention.
Figure 6:
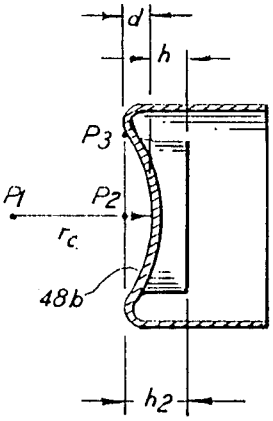
FIG. 6 is a sectioned side elevational view of the low potential electrode of FIG. 4 taken along the plane 6—6 in FIG. 4.

Referring now to FIGS. 4, 5 and 6, there is shown the low potential electrode 41 of another embodiment of the invention, in which apertures 49, 50*a*, and 50*b* are similar in shape to apertures 39, 40*a* and 40*b* of FIG. 3. However, FIG. 6, a section view along plane 6—6 of the plan view of FIG. 4, shows a partition wall 48*b* having a height which decreases toward the center of the electrode. In this embodiment, the top longitudinal edge of the wall defines an arcuate path having a radius $r_c$. The other wall 48*a*, not shown in FIG. 6, is of similar shape. For a smooth blend from center to edge, $r_c$ is preferably determined by the formula $$r_c = \frac{d^2 + r_b^2}{2d}$$

Figure 7:
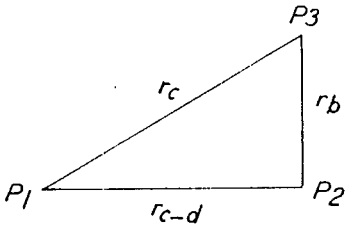
FIG. 7 is a right triangle whose apices correspond to points $P_1$, $P_2$ and $P_3$ of FIG. 6.

In this relationship, $r_c$ defines the length of the long side of a right triangle whose corners lie at points $P_1$, $P_2$ and $P_3$ in FIGS. 6 and 7, and $r_c - d$ and $r_b$ define the lengths of the remaining sides, respectively. The value for $r_c$ is then found using the Pathagorean theorem.

An example of the above-described embodiment is presented for a mini-neck (22.8 mm neck OD) gun assembly. The main focusing electrode potential is substantially 25 to 35 percent of the final accelerating electrode potential. The interelectrode spacing is about 0.040". Electrode dimensions are substantially as follows:

| Main Focusing Electrode (41) | Dimensions in the order of: | |
|---|---|---|
| Beam Spacings ($S_1$) center-to-center | 0.177 inch | |
| Dia. (A) of Apertures (49, 50a, 50b) | 0.190 inch | |
| Radius ($r_a$) | 0.070 inch | |
| Radius ($r_b$) | 0.095 inch | |
| Elongation (x) | 0.050 inch | |
| Width (w) of Walls (38a, 38b) | 0.037 inch | |
| Relationship of (d) to | d | $r_c$ |
| Radius ($r_c$) | 0.015 inch | 0.308 inch |
| | 0.030 inch | 0.165 inch |
| | 0.045 inch | 0.123 inch |

| Final Accelerating Electrode | Dimensions in the order of: | |
|---|---|---|
| Beam Spacings ($S_2$) center-to-center | 0.182 inch | |
| Dia. (A) pf Apertures | 0.199 inch | |
| Radius ($r_a$) | 0.075 inch | |
| Radius ($r_b$) | 0.100 inch | |
| Elongation (x) | 0.050 inch | |
| Width (w) | 0.032 inch | |
| Relationship of (d) to ($r_c$) | d | $r_c$ |
| | 0.015 inch | 0.338 inch |
| | 0.030 inch | 0.180 inch |
| | 0.045 inch | 0.133 inch |

It is to be understood that the foregoing exemplary dimensions are not to be considered limiting.

Use of the described structures in both the high potential and low potential electrodes which generate the final lenses provides small, round beam spot landings. If the structures were incorporated in only one of the electrodes, smaller spot sizes than for conventional structures would be realized, but the spots would tend to be distorted.

While there have been shown and described what are at present considered to be the preferred embodiment of the invention, it will be obvious to those skilled in the art that various changes and modifications may be made therein without departing from the scope of the invention as defined in the appended claims.

I claim:

1. In an in-line electaron gun structure for a color cathode ray tube, a lensing arrangement in the final focusing and accelerating electrodes comprising:

a first lensing structure in the forward portion of the focusing electrode, such structure having an upstanding perimetrical rim defining an oval-shaped cavity, and two upstanding partition walls extending across the width of the cavity, at least a central portion of the walls having a height substantially less than the height of the rim, the rim and walls together defining three vertically elongated in-line apertures, the central aperture being oblong and the side apertures being D-shaped, and a second lensing structure in the rear portion of the final accelerating electrode in adjacent, facing relationship with the first structure, such second structure having an upstanding perimetrical rim defining an oval-shaped cavity, and two upstanding partition walls extending across the width of the cavity, at least a central portion of the walls having a height substantially less than the height of the rim, the rim and walls together defining three vertically elongated in-line apertures, the central aperture being oblong and the side apertures being D-shaped.

2. The gun structure of claim 1 wherein the height of the rim of the second lensing structure is greater than the height of the rim of the first lensing structure.

3. The gun structure of claim 1 wherein the height of the partition walls is substantially constant across the cavity.

4. The gun structure of claim 1 wherein the height of the partition walls decreases toward the center of the cavity.

5. The gun structure of claim 4 wherein the top longitudinal edges of the partition walls define an arc.

6. The gun structure of claim 5 wherein the arc is circular.

7. The gun structure of claim 6 wherein the radius of the arc is about $$r_c = \frac{d^2 + r_b^2}{2d}$$

where d is the height of the rim, and $r_b$ is the radius of the outer sides of the side apertures.

8. The gun structure of claim 1 wherein the distance between the centers of the side apertures being greater in the second lensing structure than in the first lensing structure.

9. The fun structure of claim 1 wherein the apertures of the second structure are larger than the apertures of the first structure.

* * * * *